United States Patent [19]

Wennberg et al.

[11] 4,150,921

[45] Apr. 24, 1979

[54] BUILT-UP MARINE PROPELLERS WITH ADJUSTABLE PITCH AND AXIALLY REMOVABLE BLADES

[75] Inventors: Peder K. Wennberg, Federal Way; Mark E. Eastman, Kent, both of Wash.

[73] Assignee: Propulsion Systems, Inc., Kent, Wash.

[21] Appl. No.: 819,883

[22] Filed: Jul. 28, 1977

[51] Int. Cl.[2] ..... B63H 3/12

[52] U.S. Cl. ..... 416/207; 416/208

[58] Field of Search ..... 416/207, 208

[56] References Cited

U.S. PATENT DOCUMENTS

| | | | |
|---|---|---|---|
| 2,232,670 | 2/1941 | Barrett | 416/207 |
| 2,574,951 | 11/1951 | Benson | 416/208 |
| 3,073,395 | 1/1963 | Duncan | 416/208 |
| 3,130,677 | 4/1964 | Liebhart | 416/208 |
| 3,294,175 | 12/1966 | Bodner | 416/208 |

FOREIGN PATENT DOCUMENTS

| | | | |
|---|---|---|---|
| 104286 | 6/1938 | Australia | 416/208 |
| 238027 | 10/1959 | Australia | 416/208 |
| 352782 | 7/1931 | United Kingdom | 416/208 |

*Primary Examiner*—Everette A. Powell, Jr.
*Attorney, Agent, or Firm*—Larson, Taylor and Hinds

[57] ABSTRACT

Marine propellers are constructed with a split-hub design, permitting adjustment of the pitch of the blades, and axial removability of the blade. By virtue of the axial removability of the blades, blades can be removed easily for repair or replacement without increasing the diametral clearance between the blade tips and a tunnel or nozzle of the type in which propellers are frequently disposed. Also, individual blades can be removed without the necessity of dropping the rudder, which is necessary in many vessels utilizing solid propellers. The blades have their spindles or roots clamped in the hub, such that axial adjustment of pitch can be achieved by reducing the clamping force. The hub preferably is formed in two sections, one section being mounted to or forming part of the propeller shaft, and including recesses which partially house the blade spindles or roots. The other section preferably is made up of a plurality of independently removable clamping segments, each of which is formed with a recess which cooperates with a recess in the first section to house a blade spindle, and clamp the spindle in a fixed blade pitch position. By removal of a selected clamping segment, its blade can be removed axially rearwardly without necessitating substantial diametral clearance at the blade tips. Bolted connections are used between the clamping segments and the first section of the hub so as to facilitate both pitch adjustment and blade removal.

8 Claims, 2 Drawing Figures

BUILT-UP MARINE PROPELLERS WITH ADJUSTABLE PITCH AND AXIALLY REMOVABLE BLADES

FIELD OF THE INVENTION

This invention relates to marine propellers, and more specifically to improved marine propulsion propellers having axially removable blades and adjustable pitch, achieved by an improved built-up hub assembly.

BACKGROUND AND SUMMARY

Commercial marine operators have available to them generally three types of marine propellers. These include controllable pitch propellers in which blade pitch is continuously variable, solid propellers with fixed pitch, and various forms of built-up propellers with removable blades and/or adjustable pitch. Controllable pitch propellers are far superior operationally, and if they have any disadvantages, it would lie in the initial cost, which sometimes is a controlling factor, regardless of the favorable pay-out times arising from the improved operational efficiency. For most operations, the least desirable of the types of propellers are the fixed pitch solid propellers, the operating inefficiencies of which are well known, as is the substantial expense of repair. For instance, if a blade is damaged, the operator cannot remove the blade and replace it with a spare, but instead must change the entire propeller, at least during repair time. This is time consuming and costly. A further consideration is that many, if not most, of the river towboats used in inland waters have nozzles fitted around the propellers. When those propellers become damaged, they must pull the shaft and drop the rudders in order to change the propeller. This is a substantial job. At least relative to the fixed pitch solid propellers, river operators prefer the features of a built-up propeller since, if they damage one or two blades, they can remove those blades and replace them with spares. However, many of these built-up propellers have their blades attached through a bolted arrangement such that a blade must be displaced along its own longitudinal axis, i.e., radially with respect to the hub, in order to be removed or replaced, and with such an arrangement it is not possible to remove the blade when positioned within a nozzle, as is commonly the case with river towboats used on the Mississippi River and the Great Lakes, since there is insufficient tip clearance to permit lifting the blade out of the hub counterbore. We are aware of no adjustable pitch, built-up propeller in which the blades are removable without increasing the overall diameter of the propeller during removal, by virtue of having to move the blades radially outwardly to clear the hub counterbore. Perhaps this is one reason, possibly among others, that built-up propellers have not been adopted as widely as some of their advantages would seem to dictate. In our opinion, the industry needs, but the prior art has not provided, an adjustable pitch, built-up propeller which constitutes a meaningful compromise between the disadvantages of fixed pitch solid propellers and the operational advantages but high initial cost of controllable pitch propellers. Our invention proposes a design of adjustable pitch, built-up propellers which achieves this, and provides attractive economies of manufacture and operation.

As indicated above, built-up, adjustable pitch propellers are known in the art, exemplary ones being shown in U.S. Pat. No. 3,255,827 (Nichols) and U.S. Pat. No. 3,594,099 (Herbert). To our knowledge, these are subject to the disadvantage that their constructions do not permit blade removal in other than a radial direction from the hub, that is, such as to require diametral clearance around the blade tips, which clearance is not always available. It is also known in the art to provide built-up marine propellers in which the blades may be removed axially of the hub, such as not to require diametral clearance, although we cannot say that this was a recognized advantage in the prior art of which we are aware. Examples of earlier patents where axial removal of blades appears possible are U.S. Pat. Nos. 548,655 (Pagan), 787,745 (Freid), and 1,122,925 (Henrichsen). These prior art proposals are individually subject to one or more of various disadvantages, such as being not capable of pitch adjustment, being constructed such that selective removal of one or more blades without disturbing the other blades is not reasonably feasible, and simply incorporating designs and constructions that would be completely unrealistic for the power requirements of modern commercial marine vessels. For instance, the propellers of the Freid and Henrichsen patents are incapable of blade pitch change, along with their other obvious deficiencies. The propeller of the Pagan patent has a pitch change capability, but, in addition to being of highly unrealistic design and construction, is akin to a house of cards, in that removal of bolts sufficient to permit removal of one blade would cause collapse of substantially the entire assembly. The Pagan patent simply teaches nothing to the modern technology of commercial marine propeller design.

Although we do not consider it to constitute analogous technology, we have become aware of various rotary fan constructions wherein it is possible to effect non-radial removal of the fan blades and adjustment of their pitch. Exemplary of these constructions are U.S. Pat. Nos. 2,232,670 (Barrett) and 2,573,875 (Riddiford). We consider that their constructions and their teachings are unsuitable for use in marine propulsion systems. Additionally, blade replacement in these fan constructions while still mounted on the fan shaft would be at least extremely difficult, since the only structure retaining the blade mounting blocks on the periphery of the blade or hub plate is the cover plate, which must be removed in order to replace a blade. In this respect, these constructions are subject to the disadvantages of the previously mentioned Pagan patent.

In accordance with our invention, we provide an adjustable pitch, marine propeller in which the blades are removable generally axially of the hub. The hub is of split construction, having forward and aft sections in which a plurality of mating recesses are formed, fore and aft recesses cooperating to form housings for the blade roots or spindles. The recesses formed in the forward hub section partially receive the roots of the propeller blades such that, with the aft section removed, the blades are removable by axial displacement in a direction at least generally parallel to the longitudinal axis of the hub, and, with the clamping force of the aft section lessened, each blade is adjustable about its root axis so as to permit pitch adjustment. The engagement between the forward hub section recesses and the blade roots preferably is such that, under static conditions, a blade is supported by its forward recess until physically moved axially rearwardly. In our preferred construction, the aft hub section comprises a plurality of clamping segments, with each clamping segment having a recess formed therein cooperating with a recess in the forward hub section as mentioned above. In the assembled condition, the blade roots are clamped in their housings between the forward hub section and the clamping segments, such that pitch-changing rotation of the blades is prevented, but may be selectively permitted by lessening the clamping force. Preferably each clamping segment is removably mounted independently on the forward hub section, through an advantageous arrangement of bolts which we have found to be effective in accommodating the stresses and forces arising during operation.

In keeping with our preferred construction, the forward hub section has a radially recessed support section extending axially rearwardly, and the inner surface of each clamping segment is configured for mating engagement with a portion of the outer surface of the support section when the clamping sections are mounted. We prefer that the outer surface of the support section have a polygonal peripheral configuration when viewed axially of the longitudinal axis of the hub, such that a plurality of planar clamping segment engaging surfaces are defined, with each planar surface aligned with a corresponding forward hub section recess.

To minimize or restrain centrifugal strain generated by rotation of the propeller, we prefer that each clamping segment is formed with a radially recessed lip extending axially rearwardly, the outer surface of which lip defines a spigot surface. A retaining means, preferably in the form of a retaining ring, encompasses the spigot surfaces when the clamping sections are mounted, and preferably the lips of the clamping segments are configured such that the spigot surfaces form a continuous circular surface surrounded and embraced by a circular ring.

Other advantages and features, as well as objects, of our invention will become apparent from the ensuing description of a preferred embodiment, taken with reference to the appended drawings.

BRIEF DESCRIPTION OF THE DRAWING FIGURES

DETAILED DESCRIPTION OF PREFERRED EMBODIMENTS

Figure 1:
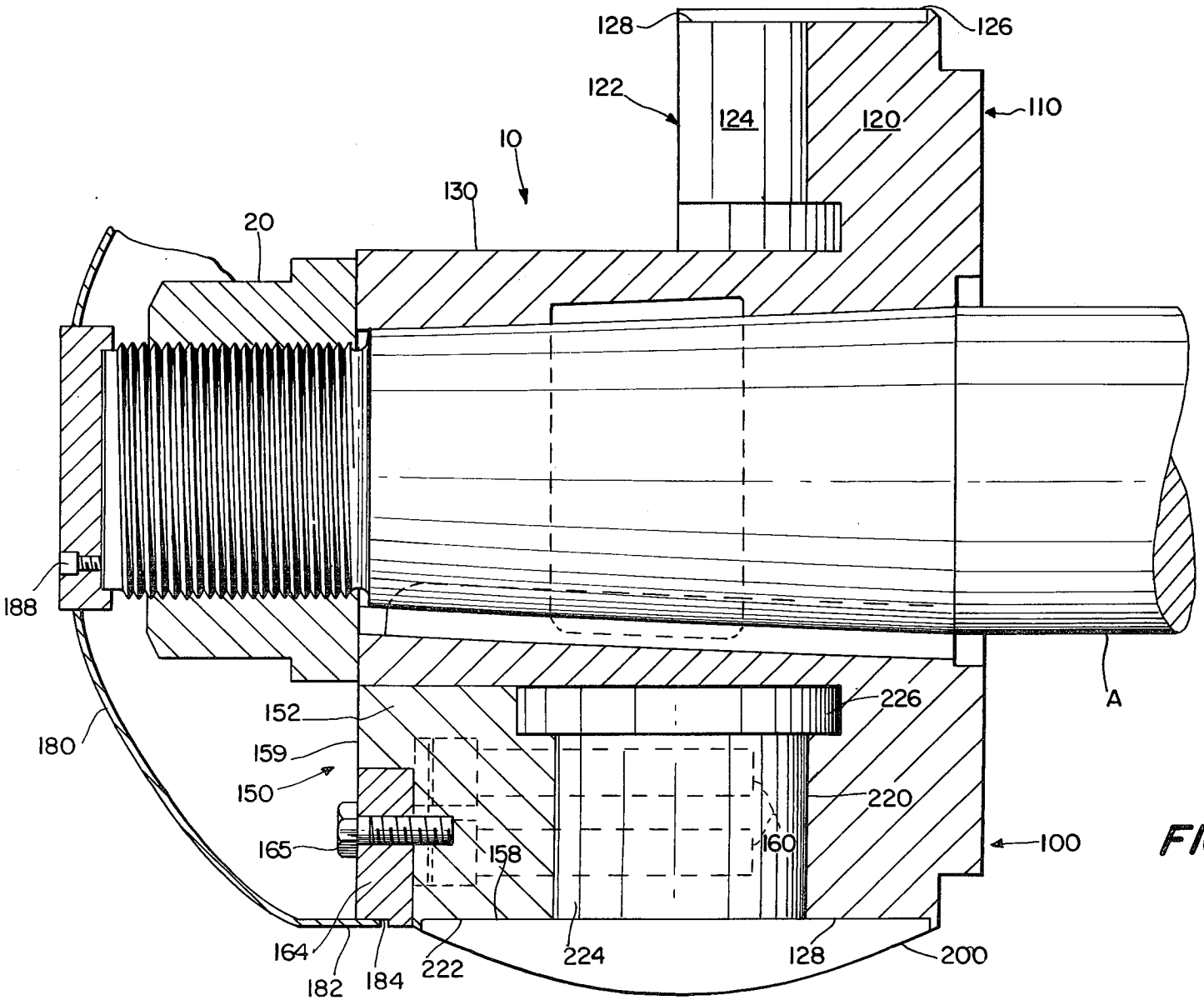
FIG. 1 is a side elevational cross-section view, partially cut away, of a five-bladed propeller constructed in accordance with the present invention, and mounted on a propeller shaft in one of various mounting arrangements.
Figure 2:
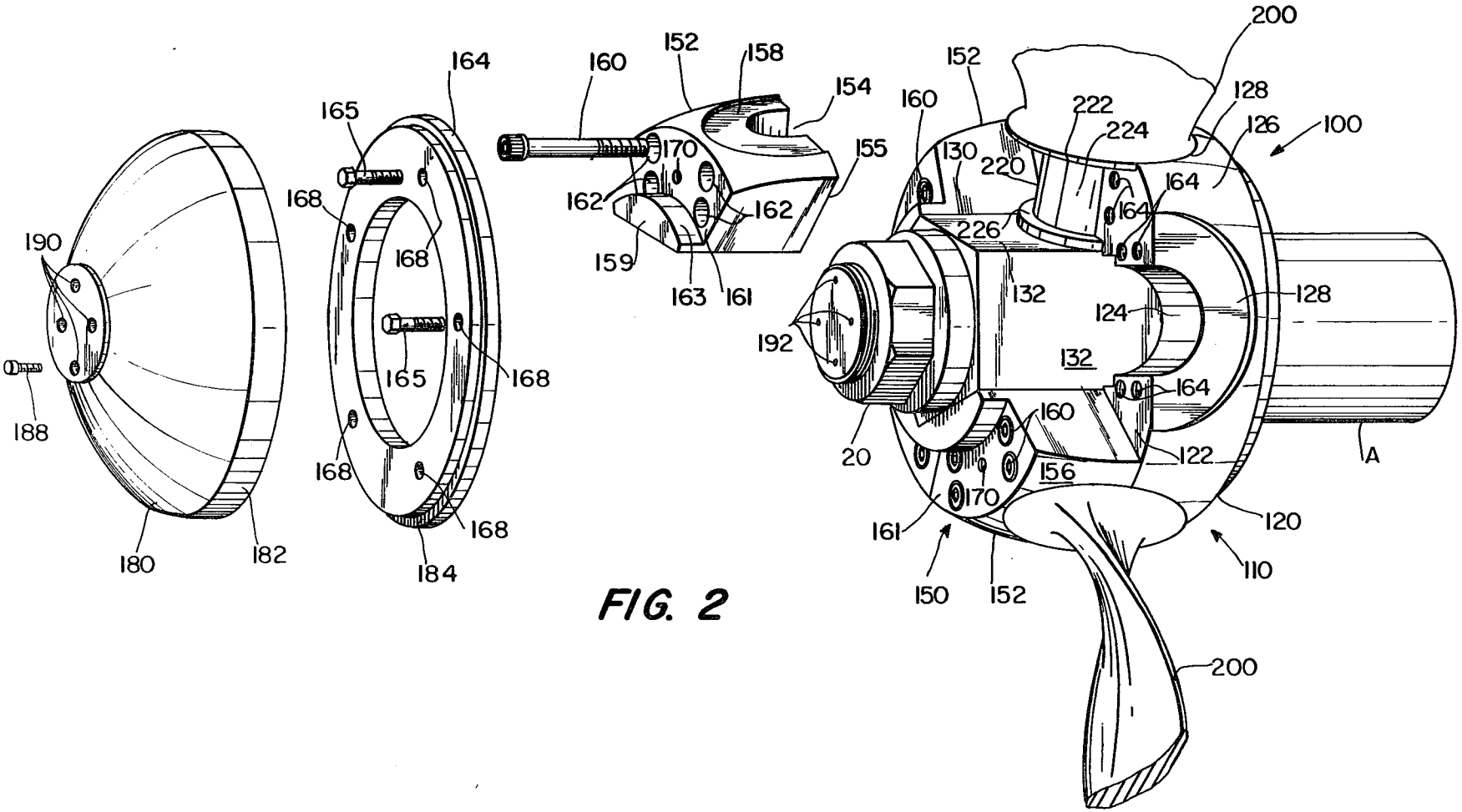
FIG. 2 is an exploded view of the propeller illustrated in FIG. 1.

Referring to the drawing figures, a propeller constructed in accordance with the present invention is generally denoted 10, and comprises a hub generally denoted 100, and a plurality of blades 200 removably mounted in the hub. In FIG. 1, only a single blade is indicated schematically at 200 in the upper part of the figure. Each blade 200 is mounted by a base or root 220, comprising a cylindrical spindle 224 between upper and lower flange portions 222 and 226. Hub 100 is partially split transversely in the central plane of rotation of blade roots 220, so as to form a forward section generally denoted 110 and an aft section generally denoted 150, this terminology being used only for convenience, since, as will be hereafter noted, forward hub section 110 includes a radially recessed rearwardly extending support section 130 which is generally coterminous with the aft hub section 150. Hub section 110 is fixedly mounted on a propeller shaft A with a conventional taper/key mounting arrangement, and is secured to the threaded end of shaft A by a nut 20. This is a conventional mounting arrangement, well known in the art, and alternatively the hub may be mounted in any other known manner, such as through a taper sleeve so as to provide a hydraulically shrunk coupling assembly. It is also contemplated, particularly for new construction, that the forward hub section will be furnished as an integral forged part of the propeller shaft. The capability of this integral arrangement is believed to constitute one advantage of the invention, and we are not aware of this having been done or suggested in the prior art.

Forward hub section 110 comprises a forwardmost portion 120 and a radially recessed support section or lip portion 130 extending axially from end face 22 of portion 120. Forwardmost portion 120 is formed with a plurality of circumferentially spaced recesses 124, of semicircular section, and configured to rotatably receive blade roots 220. As shown, recesses 124 are undercut at their inner ends so as to receive root flanges 226, and are cut away at their outer ends to provide countersunk recesses 128 to receive blade flange portions 222. It will be noted that recesses 124 and their inner and outer cut away recesses, are configured such that there is sufficient engagement between the recesses and blade roots 220 to support blades 200, at least under static conditions, until the blades are physically moved axially rearwardly. In other words, under static conditions, the blades will be supported in position in the forward hub section even though not clamped by the aft hub sections. This is important during repair or replacement, in that it permits one or more segments of the aft hub section to be removed while the blades are retained in position against unintended dislodgement. The remainder of surface 126 of the forward hub section is faired to provide a hydrodynamically streamlined configuration.

Support lip portion 130 of forward hub section 110 has a polygonal peripheral configuration when viewed axially of the longitudinal axis of hub 100, such that a plurality of planar surfaces 132, corresponding in number to the number of blades 200, are defined, respectively aligned with recesses 124 so as to provide support surfaces for aft hub section 150. Although the embodiment of support lip portion 130 as illustrated is preferred, it is not essential that lip portion 130 define planar support surfaces, or that the number of support surfaces correspond to the number of blades. Other configurations are entirely possible.

Aft hub section 150 comprises a plurality of clamping segments 152 which are independently mounted and coupled to the foward hub section 120 by means of bolts 160 passing through countersunk bores 162 provided in segments 152 and into threaded bores 164 in forward hub portion 120. Preferably the bolts 160 for each segment 152 are arranged as shown in two circumferentially spaced sets, with the bolts in each set spaced generally radially with respect to each other, which we have found to provide an advantageous distribution of the loading forces. Each clamping segment 152 is formed with a recess 154 in face 155, configured to mate and cooperate with one of the recesses 124 in hub section 110 to form a blade root housing for receiving and clamping a blade root when the clamping segment 152 is mounted on hub section 110, such that pitch-changing rotation of the corresponding blade 200 may be selectively prevented or permitted by tightening or loosening bolts 160. Outer recesses 158 are provided to generally correspond with recesses 128 in forwardmost hub portion 120, and inner cutaway portions are provided at the lower ends of recesses 154 for mating with the root flanges 226. The outer surfaces of clamping segments 152 are otherwise faired similarly to the outer surface 126 of hub portion 120.

Each clamping segment 152 is further formed with a radially recessed lip 159 extending axially from end face 161. The outer circumferential surface of each lip 159 defines a spigot surface 163, preferably of circular section, although other configurations may be utilized. A retaining means, advantageously in the form of an annular ring 164, is mounted over the spigot surfaces 163 of the mounted clamping segments 152 so as to restrain the centrifugal forces which are generated by rotation of propeller 10, and thereby limit the loading on bolts 160 to tensional forces, as opposed to a combination of tension, bending, and/or shearing forces. Ring 164 is anchored to clamping segments 152 by means of equidistantly spaced bolts 165 passing through bores 168 into threaded bores 170 in segments 152. Threaded bores 170 are preferably substantially centered between bores 162.

Although aft hub section 150 most advantageously comprises a plurality of clamping segments as illustrated, it might also comprise instead a single unitary member, but this would make for difficult handing considering the weight involved. Conversely, it is not necessary that each clamping segment 152 be a unitary member, since each segment itself may be segmented, or adjacent segments might be combined as a single segment for two or more blades. We consider the illustrated arrangement to be much preferred, however.

A hub end cap or fairwater 180 completes the propeller assembly, the fairwater comprising a generally cylindrical portion 182 which cooperates with a peripheral recess 184 of ring 164 for snugly seating fairwater 180 on ring 164. Securing is by bolts 188 passing through bores 190 into threaded bores 192 in the end of shaft A.

Assembly, disassembly and pitch adjustment will be apparent from the foregoing description and the drawings. The propeller is assembled by moving the blades axially such that their roots seat in the mating recesses formed in the forward hub section. Blade pitch is set, and then clamped at that setting by mounting and tightening down clamping segments 152. With the mounting of retaining ring 164 and end cap 180, the assembly is complete. In order to adjust the pitch of a blade, the end cap 180 and retaining ring 164 are removed, and the bolts 160 of the appropriate clamping segment 152 are loosened sufficiently to permit rotation of the blade root 220. To remove a blade, its clamping segment 152 is removed, and the blade is moved axially rearwardly until its root disengages from the recesses in the foward hub section.

It will thus be appreciated from the foregoing that our invention provides a simple and economical, yet rugged and durable, adjustable pitch marine propeller construction which permits selective removal of individual blades by axial displacement thereof without necessitating increased diametral clearance, as well as adjustment of blade pitch, all without necessitating removal of the propeller assembly from its shaft or otherwise disturbing associated rudders or propeller nozzles.

It will be understood that we have shown and described the presently preferred embodiment of our invention, and although we consider this to be much preferred, the invention itself is susceptible to modifications and other embodiments incorporating some or all of the advantages and material features of the preferred embodiment.

We claim:

1. An adjustable pitch marine propeller comprising a hub and a plurality of blades removably mounted in said hub, each of said blades having a mounting root, said hub comprising forward and aft sections, said forward section having a plurality of recesses formed in an aft-facing surface thereof for at least partially receiving said blade roots such that each of said blades is removable from said recesses by axial displacement along an axis at least generally parallel to the longitudinal axis of said hub and is adjustable about its root axis so as to permit pitch adjustment, said aft hub section comprising a plurality of clamping segments formed with recesses therein to cooperate with said recesses in said forward section to form root housings for receiving and frictionally clamping the blade roots when the clamping segments are mounted on said forward hub section, such that pitch-changing rotation of said blade is selectively prevented or permitted by relatively increasing or decreasing the clamping friction between a blade root and its root housing without necessitating rearward movement of the blade, and means for removably mounting and connecting each segment independently on said forward hub section adjacent said aft-facing surface such that the clamping segment recesses mate with the recesses in said forward hub section, and such that each segment is removable or loosenable independently of the other segments such that one blade can be adjusted or removed without affecting the frictional clamping of the blade root of any other blade.

2. A propeller as claimed in claim 1 wherein said forward hub section has a radially recessed support section extending rearwardly therefrom, and the inner surface of each clamping segment is configured for mating engagement with a portion of the outer surface of said support section when said clamping section is mounted on said forward hub section.

3. The propeller of claim 2 wherein said outer surface of said support section has a polygonal peripheral configuration when viewed axially of the longitudinal axis of said hub, such that a plurality of planar clamping segment engaging surfaces are defined, with each planar surface aligned with a corresponding forward hub section recess.

4. A propeller as claimed in claim 2 wherein each clamping segment is provided with a radially recessed lip extending axially from the aft-facing end thereof, the outer surface of each clamping segment lip defining a spigot surface, and said propeller further comprises retaining means adapted to cooperate with the spigot surfaces when said clamping segments are mounted on said forward hub section for restraining the centrifugal forces generated by rotation of said propeller.

5. A propeller as claimed in claim 4 wherein said clamping segment lips are configured such that said spigot surfaces form a continuous circular surface when said clamping segments are mounted on said forward hub section, and said retaining means comprises an annular ring encompassing said circular surface.

6. A propeller as claimed in claim 1 wherein said mounting means comprises first and second circumferentially spaced sets of bolts for each clamping segment, the bolts in each set being generally radially spaced from one another.

7. A propeller as claimed in claim 1 wherein each of said blade roots comprises a cylindrical spindle portion of reduced diameter and a flange portion formed at the distal end of said cylindrical portion.

8. A marine propeller as claimed in claim 1 wherein the engagement between the recesses in said forward hub section and the blade roots mounted therein is such that, under static conditions, a blade root will remain supported by its recess after removal of its associated clamping segment, and until physically moved axially rearwardly.

* * * * *